US007958971B2

(12) United States Patent
Mangini et al.

(10) Patent No.: US 7,958,971 B2
(45) Date of Patent: Jun. 14, 2011

(54) WIRELESS, SELF-CONTAINED ELEVATOR CALL REQUEST ENTRY SYSTEM

(75) Inventors: Richard J. Mangini, Brookfield, CT (US); Richard J. Pulling, Avon, CT (US); Paul Stranieri, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 634 days.

(21) Appl. No.: 12/088,977

(22) PCT Filed: Oct. 4, 2005

(86) PCT No.: PCT/US2005/035511

§ 371 (c)(1),
(2), (4) Date: Apr. 2, 2008

(87) PCT Pub. No.: WO2007/040532

PCT Pub. Date: Apr. 12, 2007

(65) Prior Publication Data

US 2008/0264731 A1 Oct. 30, 2008

(51) Int. Cl.
*B66B 1/34* (2006.01)

(52) U.S. Cl. ..... 187/396; 187/380; 187/392

(58) Field of Classification Search ..... 187/247, 187/380–389, 391–396, 901; 709/219
See application file for complete search history.

(56) References Cited

U.S. PATENT DOCUMENTS

| | | | | |
|---|---|---|---|---|
| 5,541,585 | A * | 7/1996 | Duhame et al. | 340/5.62 |
| 5,689,094 | A | 11/1997 | Friedli et al. | |
| 6,382,363 | B1 | 5/2002 | Friedli | |
| 6,868,945 | B2 * | 3/2005 | Schuster et al. | 187/380 |
| 6,986,408 | B2 | 1/2006 | Takeuchi | |
| 7,328,775 | B2 * | 2/2008 | Zaharia et al. | 187/396 |
| 7,347,303 | B2 * | 3/2008 | Kontturi et al. | 187/380 |
| 7,353,915 | B2 * | 4/2008 | Zaharia et al. | 187/388 |
| 7,377,364 | B2 * | 5/2008 | Tyni et al. | 187/380 |
| 7,559,408 | B2 * | 7/2009 | Flynn et al. | 187/396 |
| 7,584,269 | B2 * | 9/2009 | Moore et al. | 709/219 |
| 7,849,974 | B2 * | 12/2010 | Stanley et al. | 187/387 |
| 2007/0131487 | A1 * | 6/2007 | Kontturi et al. | 187/391 |
| 2009/0294221 | A1 * | 12/2009 | Bahjat et al. | 187/396 |
| 2010/0051639 | A1 * | 3/2010 | Stob et al. | 222/52 |

* cited by examiner

*Primary Examiner* — Jonathan Salata
(74) *Attorney, Agent, or Firm* — Carlson, Gaskey & Olds PC

(57) ABSTRACT

A wireless, portable call request entry kiosk (14) has a control panel (19) with keys (20, 21) and a display panel for entering calls and informing passengers of the responding elevator. The kiosk has wireless communication (42, 56) with a building (43) where the kiosk is located, to transmit call requests to a dispatching controller (48). The kiosk operates on a rechargeable source such as a battery (51). A sensor (52) determines a lull in traffic, causing the kiosk to operate in a low power consumption mode.

14 Claims, 4 Drawing Sheets

FIG.4
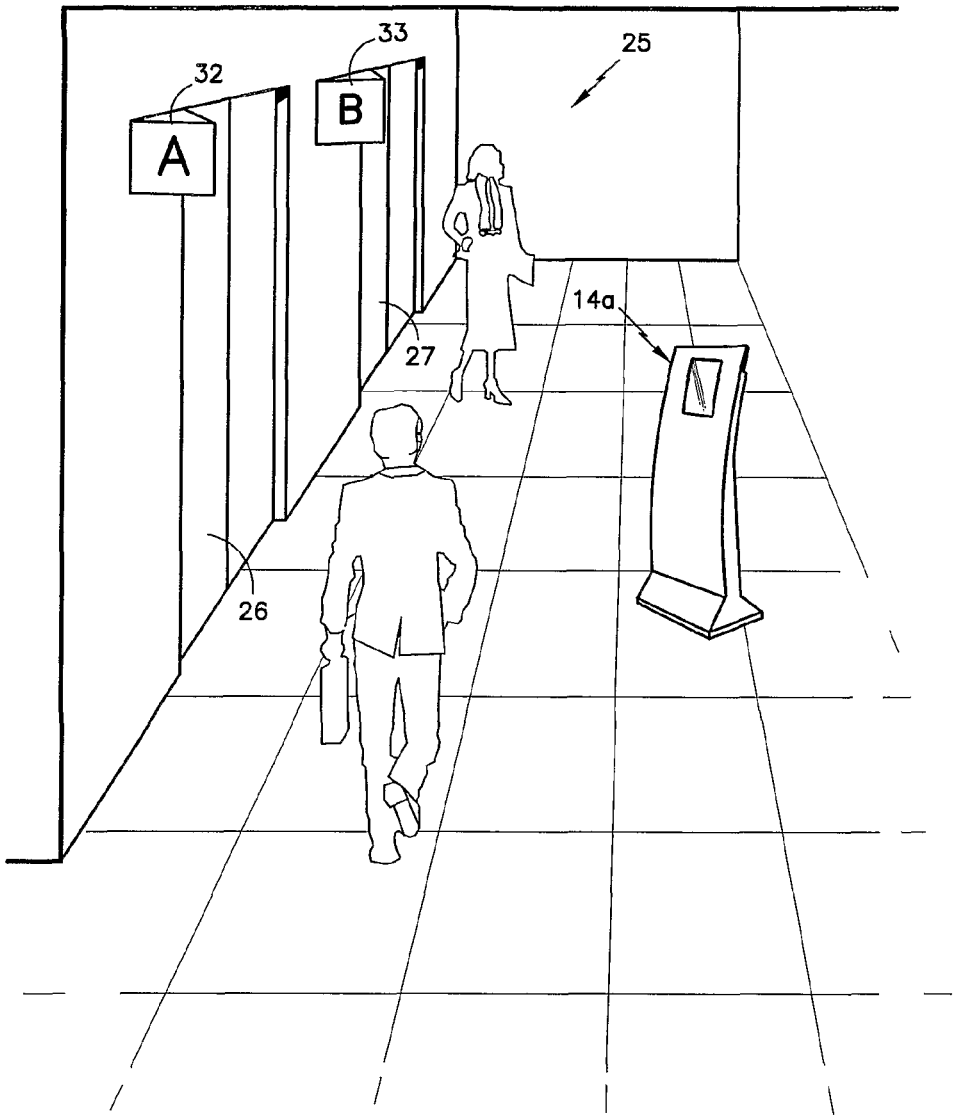
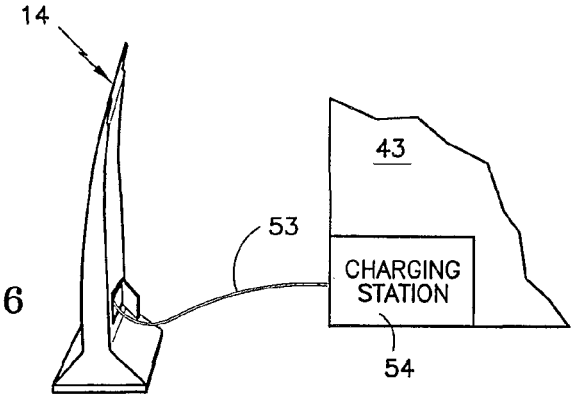
FIG.6

WIRELESS, SELF-CONTAINED ELEVATOR CALL REQUEST ENTRY SYSTEM

TECHNICAL FIELD

This invention relates to an elevator call entry system, such as one which receives destination calls, that is self-contained, wireless and portable.

BACKGROUND ART

It is commonplace to utilize either ten-key pads, N-key pads, or programmable touch screens for passengers to enter calls to their desired destination floors. Traditionally, call entry panels have been located on the walls of the lobby area. More recently, call entry devices have been housed in kiosks.

Call entry systems known to the art require wiring to receive power for communication of the desired destination or other call data, as well as to receive programming instructions for altering a touch screen, when such is the case. In some buildings, particularly those that have elegant architectural and/or historical features, the modernization or retrofitting to provide a wired call entry kiosk may be difficult or impossible without compromising the aesthetics of the building. A wired call entry kiosk may interfere with other aspects of architectural designs. It is likely that installation labor costs would exceed the cost of the equipment itself.

It is known that destination dispatching of elevators can be very effective in smoothing passenger traffic flow, particularly during certain peak traffic. It might be desirable to utilize destination call entry dispatching during peak periods or to augment basic dispatching during some peak periods. Flexibility of this sort is not available with wired-in call entry kiosks or other call entry panels.

DISCLOSURE OF INVENTION

Objects of the invention include: call request entry panels having minimal impact on architectural aesthetics, improved implementation of elevator call request entry panels in areas where peak traffic is sporadic in nature; implementation of elevator call request entry panels which can serve different elevator lobbies at different times of day, such as main floor lobbies, convention meeting floor lobbies, cafeteria lobbies, etc.; provision of elevator call request entry panels with minimal installation costs; provision of elevator call request entry panels which are sufficiently flexible as to be able to be augmented by rented or leased additional apparatus to serve temporary surges in daily traffic; and improved elevator call entry apparatus.

According to the present invention, an elevator call entry panel is disposed within a self-contained, portable kiosk which is in wireless communication with a building dispatching controller.

According to the invention, the portable wireless kiosk of the invention is powered by a rechargeable, portable power source, such as a battery, and optionally may include capacitive sensors or passive infrared motion detectors to determine when there is a lull in traffic, and cause the apparatus to shift into a low power mode.

The invention may utilize conventional N-key, ten-key or programmable tactile or touch screen entry panels. The invention may also be utilized with conventional access cards, portable devices or RFIDs to input a destination floor and cause a call to be entered; and the invention may be used with identification devices such as thumb print or retina scanning means to identify a passenger and enter the predetermined destination call for that passenger.

The wireless, portable call request entry kiosk of the present invention may have a programmable touch screen, such as an LCD touch responsive screen, or the like. In such a case, the pattern on the screen may be altered from a ten-key entry pattern, to a tenant or service floor directory entry pattern, to a simple up/down call system, if desired, in dependence upon any particular implementation of the present invention. The nature of the manner of entry of calls is not critical to the invention, which instead relates to the fact that the kiosk is wireless and portable.

According to the invention, the wireless portable kiosk may be moved from one lobby floor (such as a main floor) to another lobby floor (such as a convention hall or cafeteria) as required. The wireless portable elevator call entry kiosk of the invention may be stored periodically at a battery charging station so that the self-contained power source will be recharged.

The invention has particular utility in modernizing elevator systems of architecturally significant buildings which would be compromised by excessive internal wiring. The invention is well suited to buildings having complex traffic patterns.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 4 is a perspective view of the same elevator lobby when one of the kiosks has been removed and the other one placed in a more central position.

FIG. 6 is a simplified, stylized perspective view of the wireless, portable kiosk of the invention being charged at a charging station.

MODE(S) FOR CARRYING OUT THE INVENTION

Figure 1:
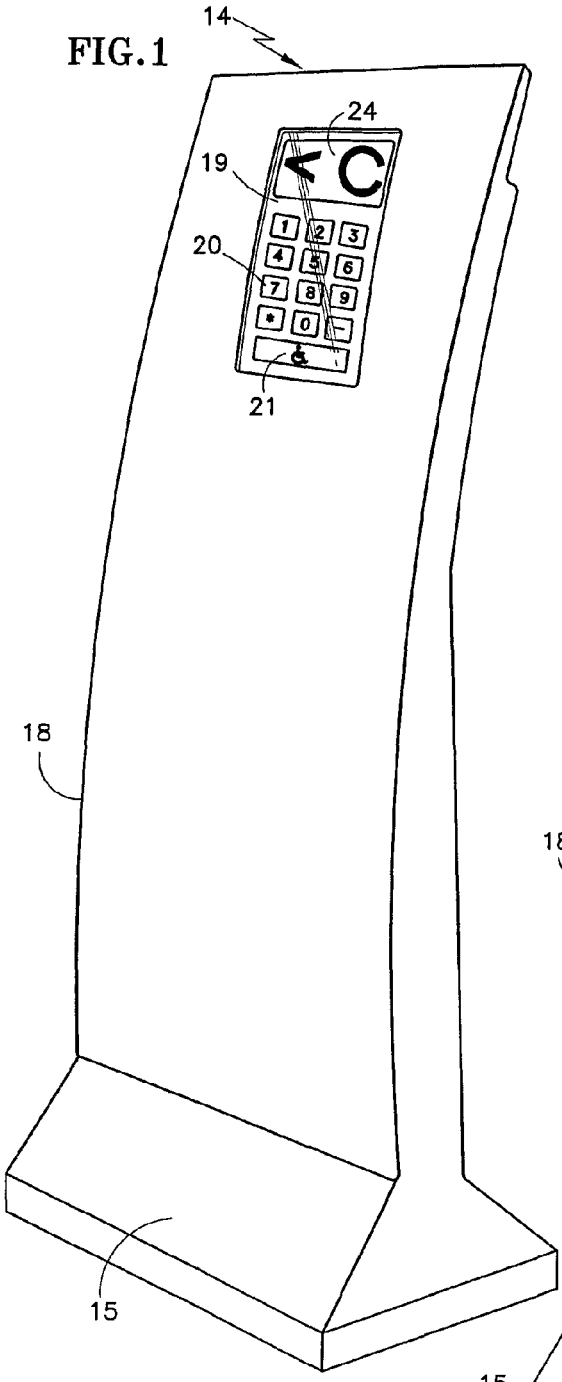
FIG. 1 is a perspective view of an exemplary wireless, portable kiosk in accordance with the present invention.

Referring to FIG. 1, a wireless portable kiosk 14 in accordance with the invention includes a base 15 which is designed to provide stability to the kiosk. The base 15 may have retractable rollers (not shown) or it may have fixed rollers and retractable feet that provide stability when in use. This is conventional and may be selected to suit any implementation of the present invention.

Figure 2:
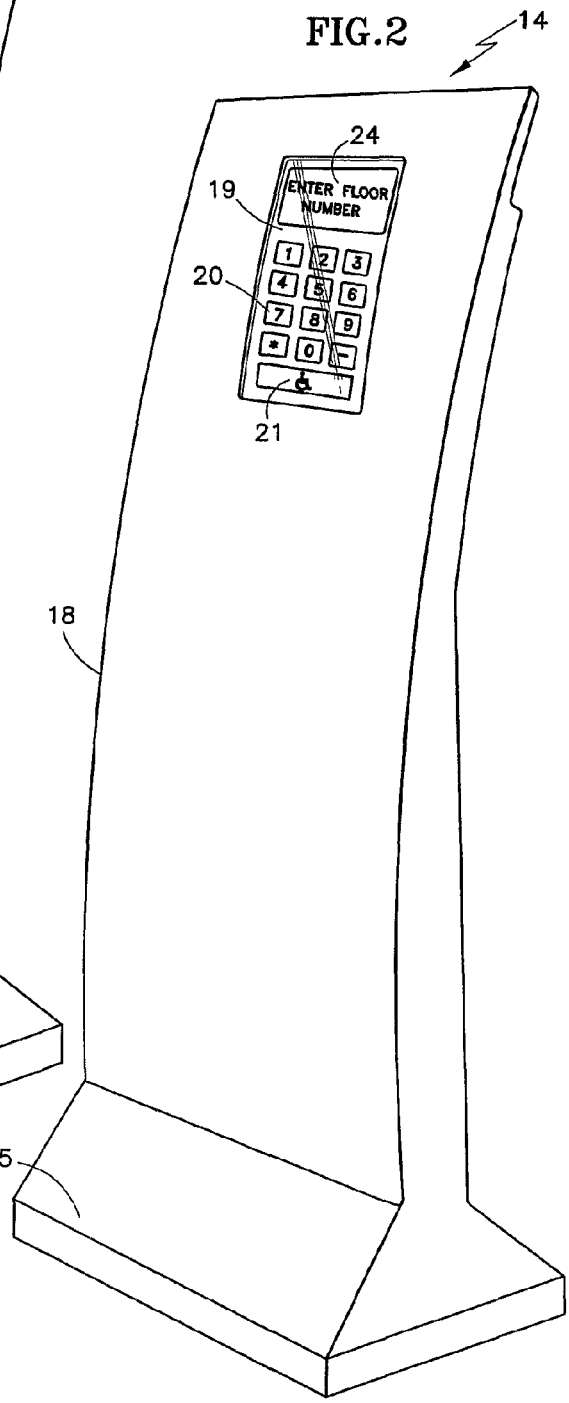
FIG. 2 is another perspective view of the present invention.

An upwardly extending portion 18 of the kiosk has a call entry panel 19 that includes a ten-key pad 20 with a handicap key 21 thereon. The keypad 20 may be conventional; it may be implemented with tactile switches or with a programmable touch screen. Above the keypad there is a display 24 which is currently displaying that the call will be answered by elevator C and that the passenger should move to the left in order to reach elevator C. A view of the ten-key entry panel shown in FIG. 2 is in the between-call mode, where the display 24 advises passengers to enter the floor number of their desired destination.

Figure 3:
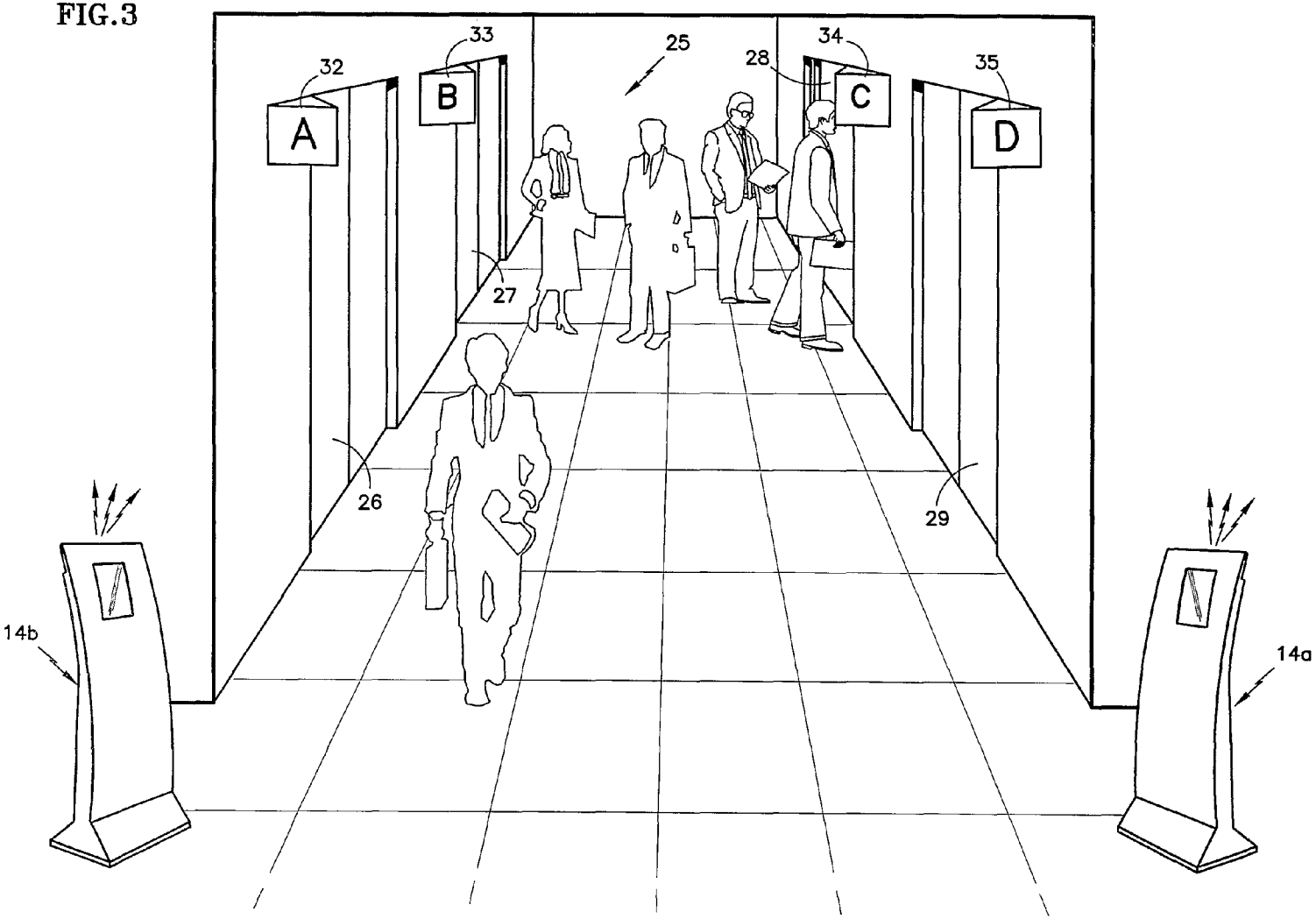
FIG. 3 is a perspective view of an elevator lobby having two wireless portable kiosks of the invention for serving passengers during periods of heavy elevator traffic.

In FIG. 3, an elevator lobby 25 includes a plurality of elevators 26-29 each having an elevator indicator 32-35 disposed adjacent thereto which is capable of illuminating to indicate the presence, or impending presence, of the related elevator. In FIG. 3, a pair of wireless, portable kiosks 14*a*, 14*b* according to the invention are disposed at diverse locations so as to be available to passengers approaching from either of two directions.

Comparison of FIG. 3 with FIG. 4 illustrates a principal advantage of the present invention, in which the same elevator lobby 25 is shown during a period of low passenger traffic, wherein the kiosk 14*a* has been moved to a central location and the kiosk 14*b* has been removed from the area, either being placed at another lobby (such as a convention hall lobby or cafeteria) or at a charging station.

Figure 5:
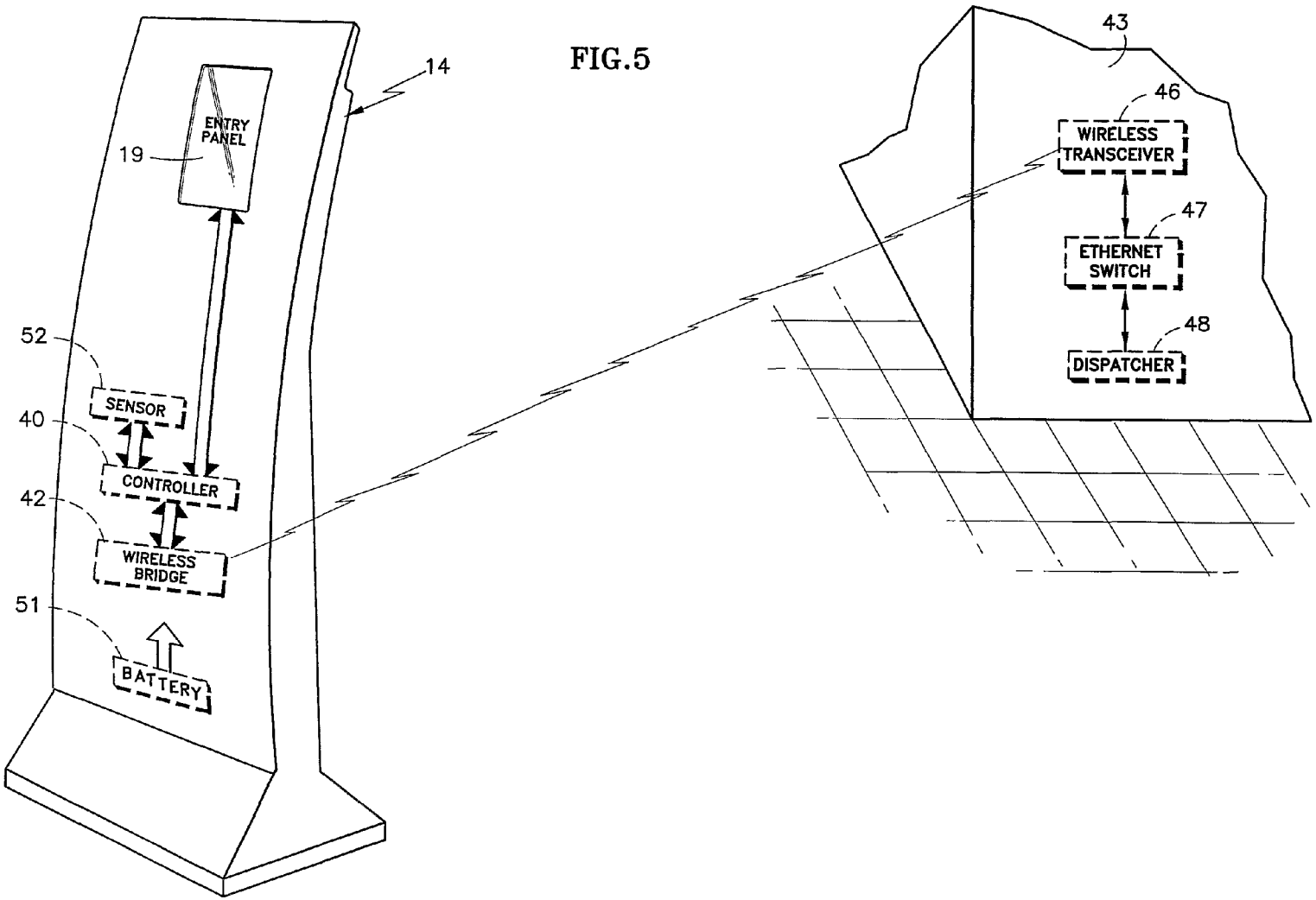
FIG. 5 is a simplified, stylized illustration of the principal components of an exemplary implementation of the invention.

Referring to FIG. 5, the wireless, portable kiosk 14 of the invention typically may include a microcontroller 40 which is interconnected with the entry panel 19 (and such other devices as may be included in the kiosk, as described hereinafter). The controller will transmit the destination call data provided by the call entry panel via a wireless bridge 42 to equipment that is hard-wired within the building 43, which may include a wireless transceiver 46 and an ethernet switch 47 that provide the call information to a dispatching controller 48, which enters the calls and allocates the calls to appropriate elevators, for service.

The equipment in the kiosk is powered by a rechargeable power source which may be a battery 51, or a bank of capacitors or supercapacitors. A sensor 52 will indicate to the controller 40 when there is a lull in traffic, enabling the controller to switch the apparatus into a low power consumption mode, whereby to conserve energy in the battery 51 or other rechargeable power source. The sensor 52 may be passive infrared, capacitance or other conventional motion or proximity sensor. Referring to FIG. 6, a wireless portable kiosk 14 according to the invention is charged by interconnection with a cable 53 at a charging station 54.

The call entry panel of the present invention may be N-key, ten-key, programmable touch screen, or other known call entry device. In addition, the kiosk may be responsive to an access card (a swipe card), a radio frequency identification device (RFID), or other personal call registering means, some of which are disclosed in PCT Patent Application No. US04/20950.

The invention claimed is:

1. An elevator call request entry system by means of which passengers will indicate a desire for elevator service to commence at a floor lobby (25) of a building (43), characterized by:

a wireless, portable call entry kiosk (14) having a controller (40) and rechargeable power source (51);

means (20) disposed within the kiosk for registering a passenger request for elevator service at a lobby of the building where the kiosk is located;

a dispatching controller (48) fixed within the building and interconnected with elevators (26-29) controlled thereby;

a wireless transmission means (42, 46) for communicating requests for elevator service from said kiosk to said dispatching controller;

a sensor (52) disposed within said kiosk to determine a lull in passenger traffic; and wherein said controller (40) causes operation of said kiosk in a low power consumption mode in response to said sensor indicating a lull in passenger traffic.

2. A system according to claim 1 further characterized by:

a charging station (53, 54) fixed within said building (43) for charging said rechargeable power source (51).

3. A system according to claim 1 wherein:

said wireless transmission means (42, 46) is implemented with Ethernet transmission.

4. A system according to claim 1 wherein:

said means (20) for registering a passenger request is a tactile key switch panel.

5. A system according to claim 1 wherein:

said means (20) for registering a passenger request is a programmable touch responsive screen.

6. An elevator call request entry system that allows a passenger to indicate a desired destination, comprising:

a wireless, portable call entry kiosk including a controller, a rechargeable power source, a sensor and a transceiver, the controller being configured for registering a passenger request for elevator service, the transceiver being configured for communicating between the kiosk and a dispatching controller associated with elevators, the sensor being configured to determine a lull in passenger traffic and wherein the controller causes said kiosk to operate in a lower power consumption mode responsive to an indication from the sensor regarding a lull in passenger traffic.

7. The system of claim 6, wherein the sensor is configured to detect at least one of presence or movement of an individual in a vicinity of the kiosk.

8. An elevator call request device, comprising a kiosk including a base that is configured to support the kiosk in a selected position on a floor of an elevator lobby, the base being configured to allow the kiosk to be moved from the selected position to another position on at least one of the floor of the elevator lobby or another floor;

a rechargeable power source supported by the kiosk; and a controller supported by the kiosk, the controller receiving power from the rechargeable power source, the controller being configured to register a passenger request for elevator service; and a transceiver supported by the kiosk for communicating between the controller and a dispatching controller located remotely from the kiosk.

9. The device of claim 8, comprising a sensor supported by the kiosk, the sensor being configured to detect at least one of presence or movement of a passenger in a vicinity of the kiosk.

10. The device of claim 9, wherein the controller instigates a low power consumption mode responsive to an indication from the sensor regarding a lull in passenger traffic in the vicinity of the kiosk.

11. The device of claim 10, comprising an input device configured to allow a passenger to place a request for elevator service and wherein the controller causes the input device to enter the low power consumption mode responsive to the indication from the sensor.

12. A method of providing elevator service, comprising the steps of:

positioning a wireless, portable call entry kiosk in a first location where a base of the kiosk is supported on an elevator lobby floor in a selected position;

receiving a passenger request for elevator service at the kiosk from each of a plurality of elevator passengers while the kiosk is in the selected position;

wirelessly communicating the received passenger requests between the kiosk and a dispatching controller that is configured to control elevators for providing the desired elevator service for each of the passengers; and subsequently moving the kiosk to place the base in a second, different position on at least one of the elevator lobby floor or another floor surface.

13. The method of claim 12, comprising charging a rechargeable power source of the kiosk when the kiosk is in the second position.

14. The method of claim 12, comprising determining if there is a lull in passenger traffic; and operating the kiosk in a low power consumption mode responsive to determining that there is a lull in passenger traffic.

* * * * *